US007146883B2

(12) United States Patent
Chen

(10) Patent No.: US 7,146,883 B2
(45) Date of Patent: Dec. 12, 2006

(54) WRENCH DRIVEN DIRECTLY TO CHANGE ITS DIRECTION OF OPERATION

(76) Inventor: Terence Chen, No. 325, Yungching Rd., Dungshan Shiang, Ilan (TW)

( * ) Notice: Subject to any disclaimer, the term of this patent is extended or adjusted under 35 U.S.C. 154(b) by 0 days.

(21) Appl. No.: 11/206,836

(22) Filed: Aug. 19, 2005

(65) Prior Publication Data

US 2006/0156868 A1 Jul. 20, 2006

(30) Foreign Application Priority Data

Jan. 14, 2005 (TW) ..... 94101253 A

(51) Int. Cl.
*B25B 13/46* (2006.01)

(52) U.S. Cl. ..... 81/63.2; 81/61; 81/62; 81/63

(58) Field of Classification Search ..... 81/61, 81/62, 63, 63.2
See application file for complete search history.

(56) References Cited

U.S. PATENT DOCUMENTS 6,662,687 B1 * 12/2003 Garg ..... 81/63.2
6,971,287 B1 * 12/2005 Lee et al. ..... 81/63.2
2003/0136230 A1 * 7/2003 Chen ..... 81/60

* cited by examiner

*Primary Examiner*—Joseph J. Hail, III
*Assistant Examiner*—Santese McDonald
(74) *Attorney, Agent, or Firm*—Rosenberg, Klein & Lee

(57) ABSTRACT

A wrench includes a wrench body, an actuating member, a pawl member, a direction control knob, a positioning device, and a driving member. Thus, the direction control knob is mounted on the drive head of the wrench body after assembly of the pawl member and the driving member, so that the direction control knob is mounted on the drive head of the wrench body easily, rapidly and conveniently, thereby facilitating assembly of the wrench and thereby decreasing costs of production.

21 Claims, 9 Drawing Sheets

WRENCH DRIVEN DIRECTLY TO CHANGE ITS DIRECTION OF OPERATION

BACKGROUND OF THE INVENTION

1. Field of the Invention

The present invention relates to a wrench, and more particularly to a wrench that is driven directly to change its direction of operation.

2. Description of the Related Art

A conventional wrench comprises a wrench body, an actuating member mounted in the wrench body, a pawl member mounted in the wrench body and having a first side engaged with the actuating member, and a direction control knob member mounted on the wrench body to control the operation direction of the pawl member. The direction control knob is formed with a hole to receive a spring and a drive member which is pushed by the spring to press a second side of the pawl member. However, the direction control knob has to provide a hole to receive the spring and the drive member, so that the direction control knob is not made easily, thereby increasing costs of fabrication. In addition, the direction control knob member is secured on the wrench body by a C-shaped snap ring, thereby causing inconvenience in assembly of the direction control knob.

SUMMARY OF THE INVENTION

The present invention is to mitigate and/or obviate the disadvantage of the conventional wrench.

The primary objective of the present invention is to provide a wrench that is driven directly to change its direction of operation exactly and rapidly.

Another objective of the present invention is to provide a wrench, wherein the direction control knob is mounted on the drive head of the wrench body after assembly of the pawl member and the driving member, so that the direction control knob is mounted on the drive head of the wrench body easily, rapidly and conveniently, thereby facilitating assembly of the wrench and thereby decreasing costs of production.

A further objective of the present invention is to provide a wrench, wherein the shaft of the direction control knob directly drives the driving member to operate the pawl member so that the pawl member is operated exactly and rapidly, thereby facilitating a user operating the drive head of the wrench body to rotate a workpiece.

In accordance with the present invention, there is provided a wrench, comprising:

a wrench body having an end provided with a drive head having an inside formed with a mounting recess having a side formed with a receiving recess connected to the mounting recess;

an actuating member mounted in the mounting recess of the drive head;

a pawl member pivotally mounted in the receiving recess of the drive head and engaged with the actuating member;

a direction control knob rotatably mounted on the drive head and having a shaft extended into the receiving recess of the drive head;

a driving member having a first end pivotally connected with the pawl member and a second end extended into the shaft of the direction control knob so that the driving member is moved by the shaft of the direction control knob to control movement of the pawl member.

Further benefits and advantages of the present invention will become apparent after a careful reading of the detailed description with appropriate reference to the accompanying drawings.

DETAILED DESCRIPTION OF THE INVENTION

Figure 1:
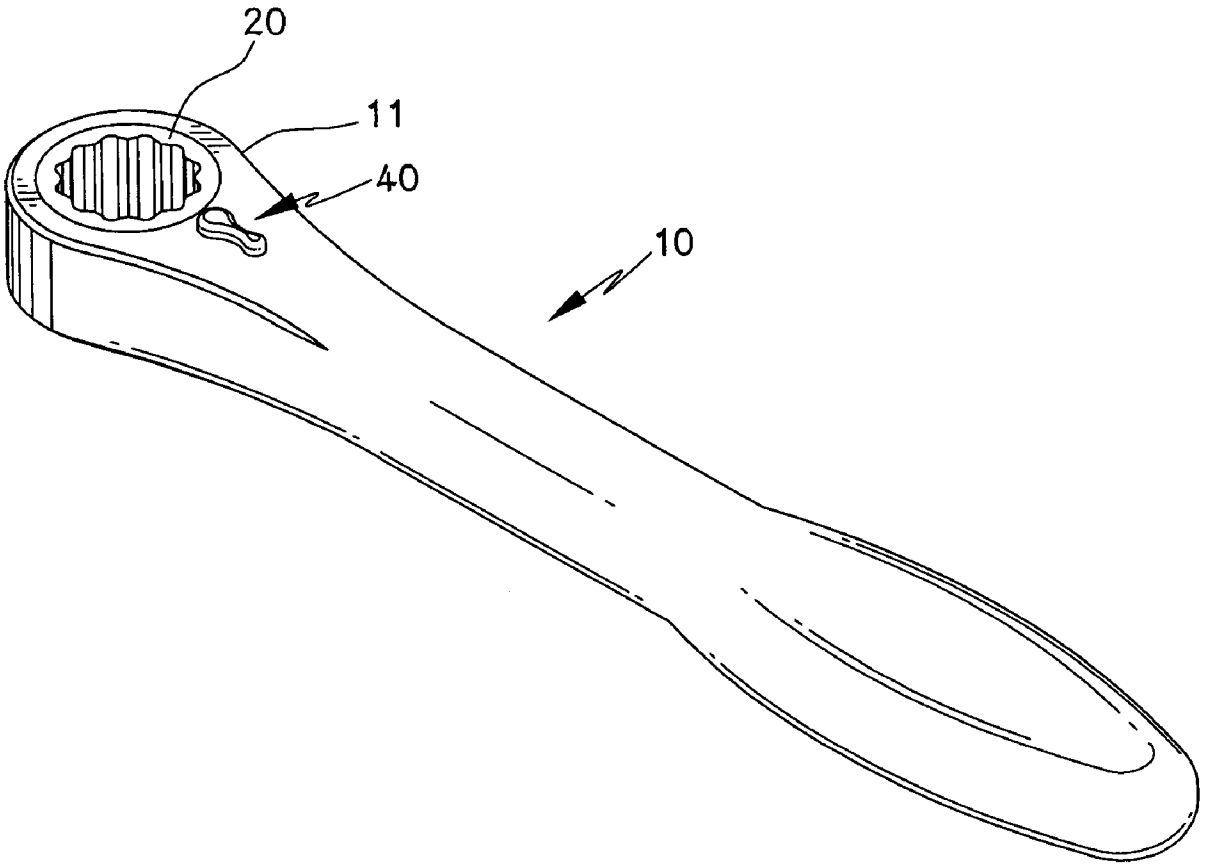
FIG. 1 is a perspective view of a wrench in accordance with the preferred embodiment of the present invention.
Figure 2:
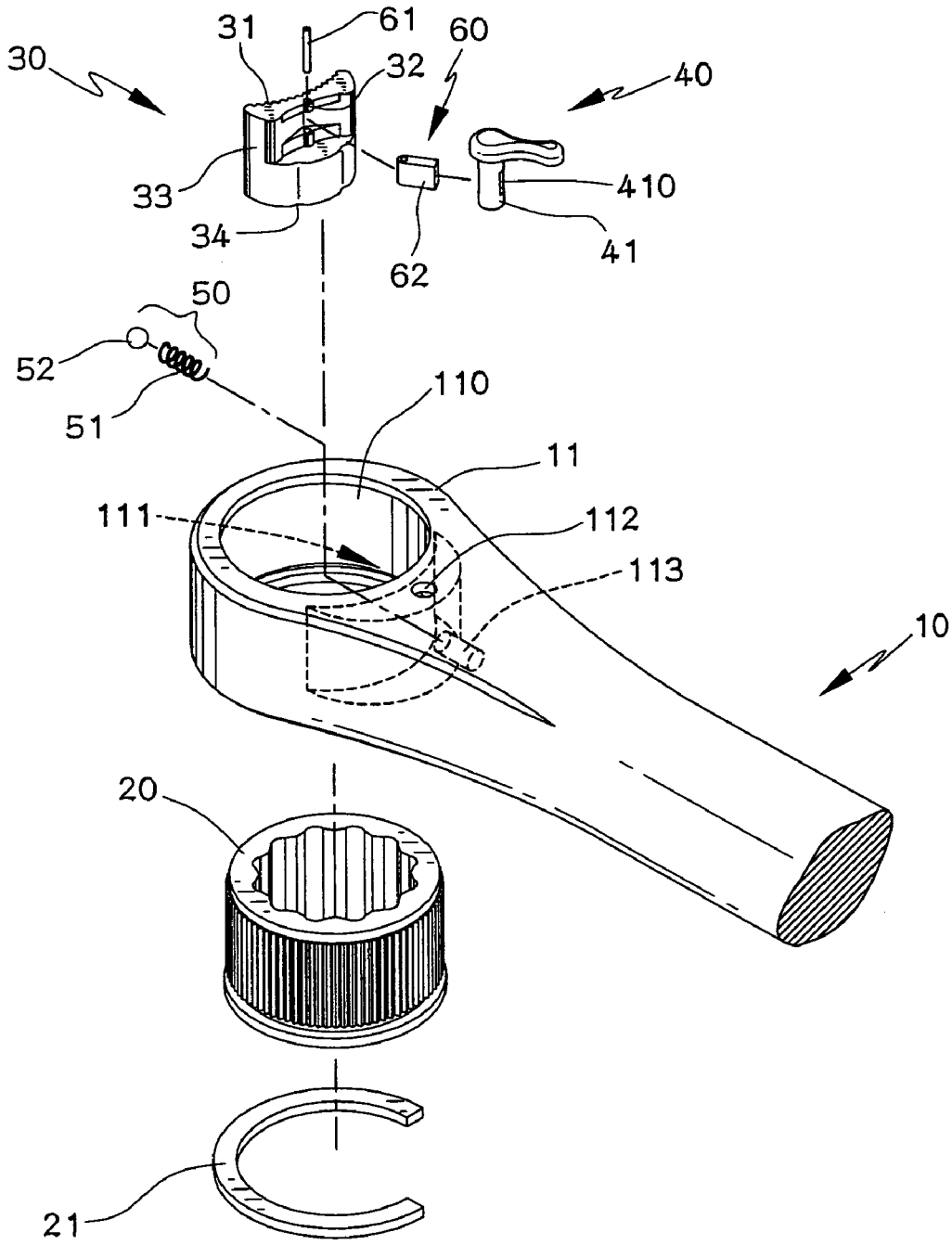
FIG. 2 is a partially cut-away exploded perspective view of the wrench as shown in FIG. 1.
Figure 3:
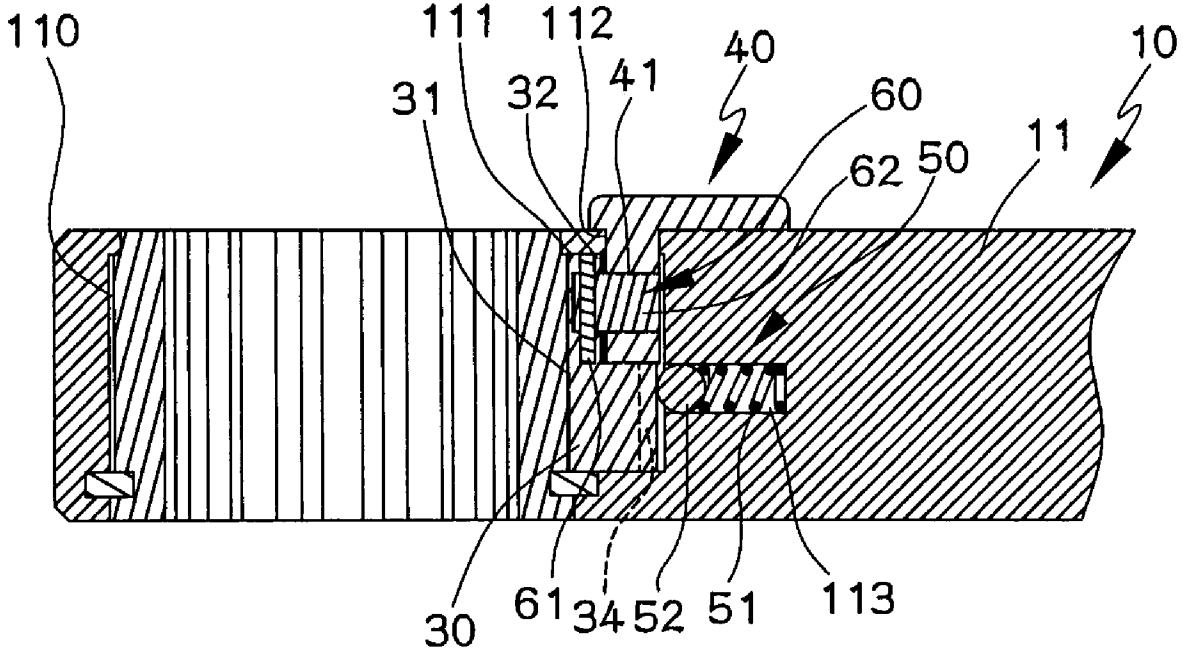
FIG. 3 is a partially cut-away plan cross-sectional view of the wrench as shown in FIG. 1.

Referring to the drawings and initially to FIGS. 1–5, a wrench in accordance with the preferred embodiment of the present invention comprises a wrench body 10, an actuating member 20, a pawl member 30, a direction control knob 40, a positioning device 50, and a driving member 60.

The wrench body 10 has an end provided with a drive head 11 having an inside formed with a mounting recess 110 having a side formed with a receiving recess 111 connected to the mounting recess 110. The drive head 11 of the wrench body 10 has an end face formed with a through hole 112 connected to the receiving recess 111. The receiving recess 111 of the drive head 11 has a side formed with a positioning hole 113.

The actuating member 20 is a ratchet wheel mounted in the mounting recess 110 of the drive head 11 by a C-shaped snap ring 21.

The pawl member 30 is pivotally mounted in the receiving recess 111 of the drive head 11.

The direction control knob 40 is rotatably mounted on the drive head 11 and has a shaft 41 extended through the through hole 112 of the drive head 11 into the receiving recess 111 of the drive head 11 and located between the pawl member 30 and a bottom wall of the receiving recess 111 of the drive head 11.

The positioning device 50 is mounted in the positioning hole 113 of the drive head 11 and includes an elastic member 51 (such as a spring) and a positioning member 52 (such as a ball). The positioning member 52 of the positioning device 50 is partially protruded from the positioning hole 113 of the drive head 11 to position the direction control knob 40 and the driving member 60.

In the preferred embodiment of the present invention, the driving member 60 has a first end pivotally connected with the pawl member 30 and a second end extended into the shaft 41 of the direction control knob 40. In addition, the shaft 41 of the direction control knob 40 has a driving slot 410 extended through the shaft 41.

The pawl member 30 has a first side provided with two pivot portions 32 (such as two pivot ears each having a pivot hole) for pivoting the first end of the driving member 60 and a second side provided with an engaging portion 31 (such as teeth) engaged with the actuating member 20. The second side of the pawl member 30 has a periphery formed with two locating portions 34 (such as locating grooves) for locating the positioning member 52 of the positioning device 50. The second side of the pawl member 30 has two ends each provided with an actuating edge 33 to mate with the receiving recess 111 of the drive head 11.

The driving member 60 includes a cylindrical pivot 61 pivotally mounted on the pivot portions 32 of the pawl member 30, and a driving portion 62 having a first end pivotally mounted on the pivot 61 so that the driving member 60 is pivotally connected with the pawl member 30 and a second end inserted into the driving slot 410 of the shaft 41 of the direction control knob 40.

Figure 4:
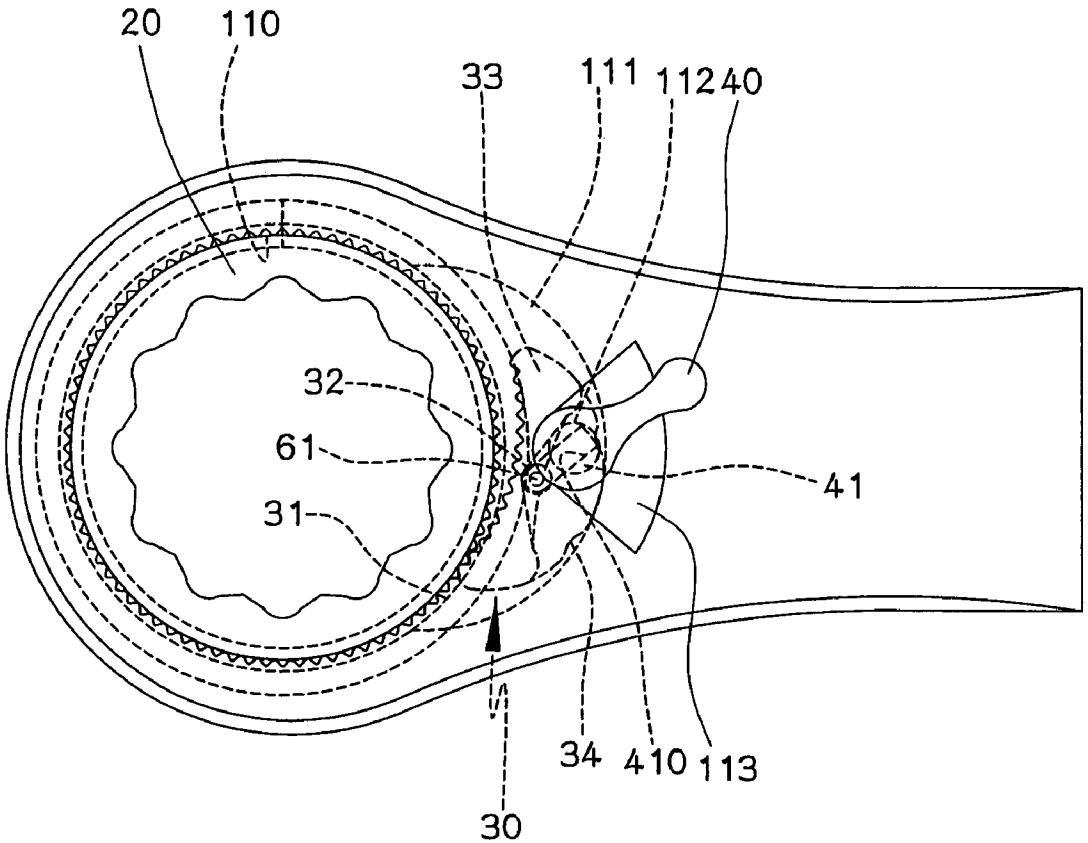
FIG. 4 is a partially cut-away top plan cross-sectional view of the wrench as shown in FIG. 1.
Figure 5:
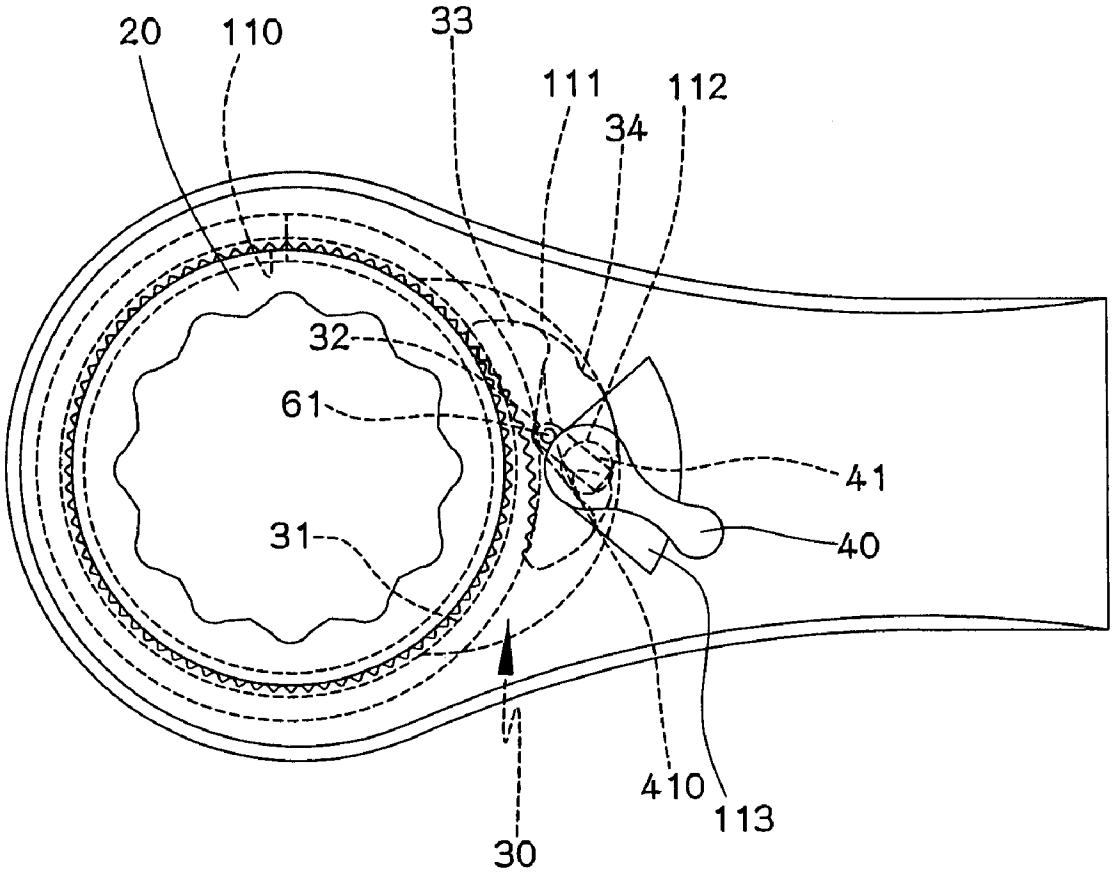
FIG. 5 is a schematic operational view of the wrench as shown in FIG. 4.

As shown in FIGS. 4 and 5, when the direction control knob 40 is rotated, the shaft 41 is rotated to rotate the driving slot 410 which moves the driving member 60 which moves the pawl member 30 so as to change the operation direction of the pawl member 30 so that the pawl member 30 drives the actuating member 20 in two opposite directions. At this time, the positioning member 52 of the positioning device 50 is locked in either one of the two locating portions 34 of the pawl member 30 to position the pawl member 30.

Figure 6:
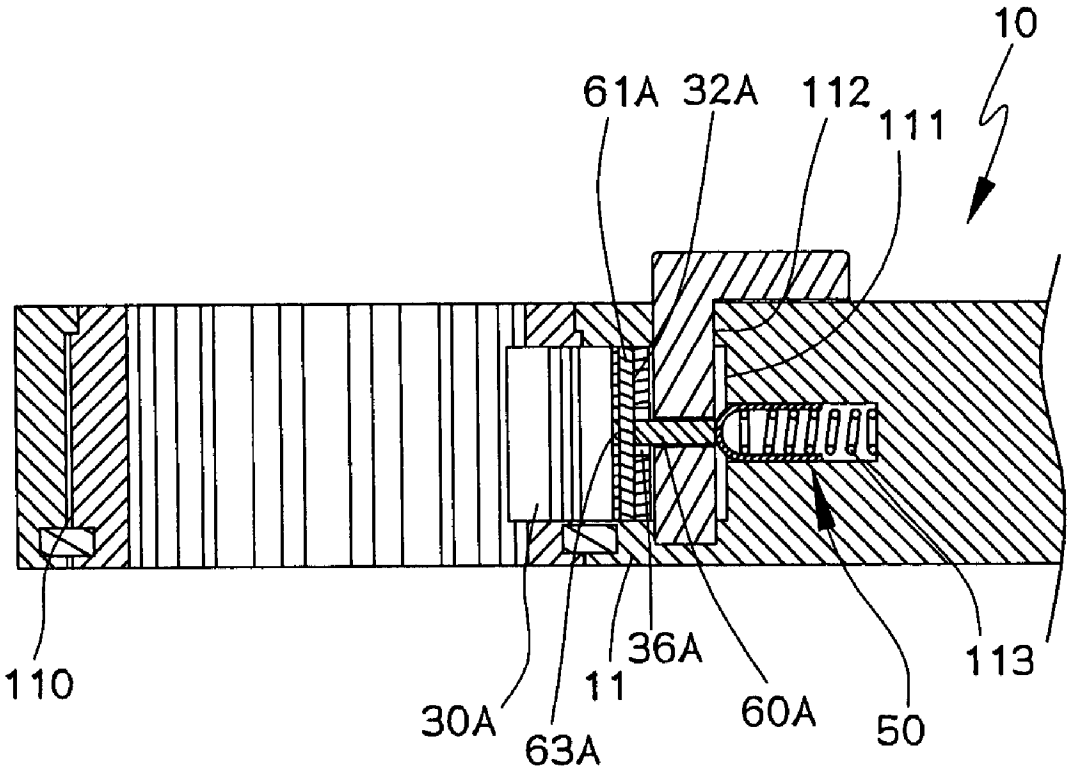
FIG. 6 is a partially cut-away plan cross-sectional view of a wrench in accordance with another preferred embodiment of the present invention.
Figure 7:
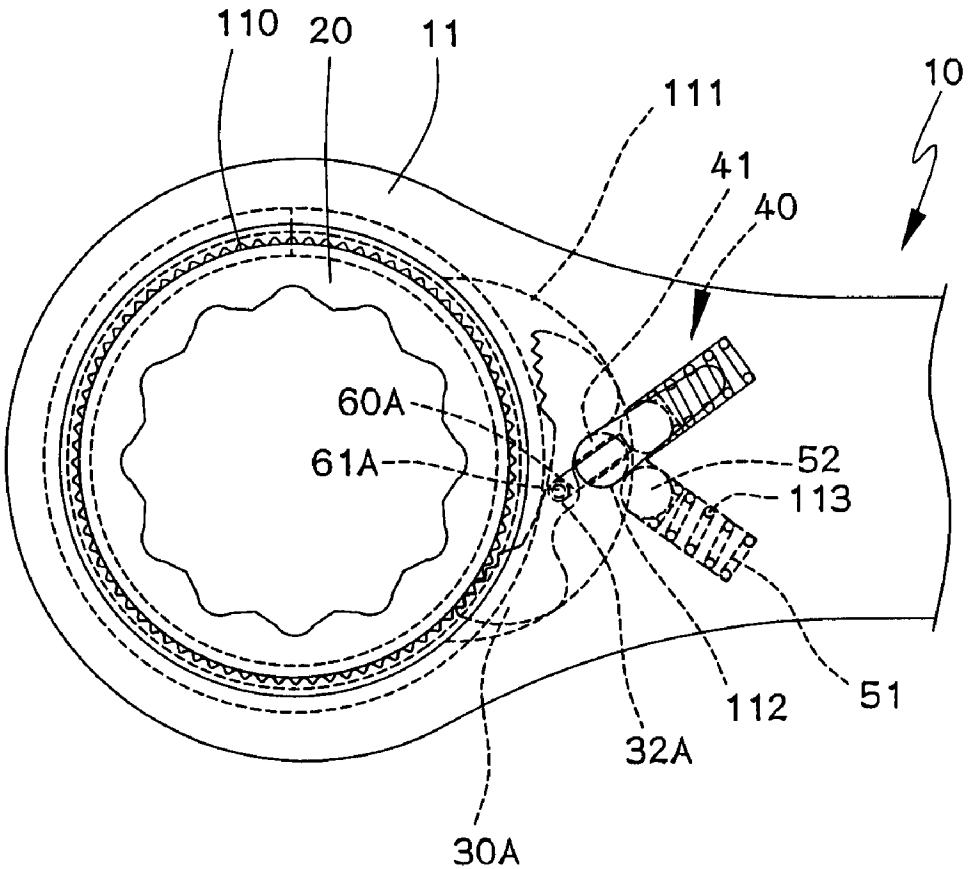
FIG. 7 is a top plan view of the wrench as shown in FIG. 6.
Figure 8:
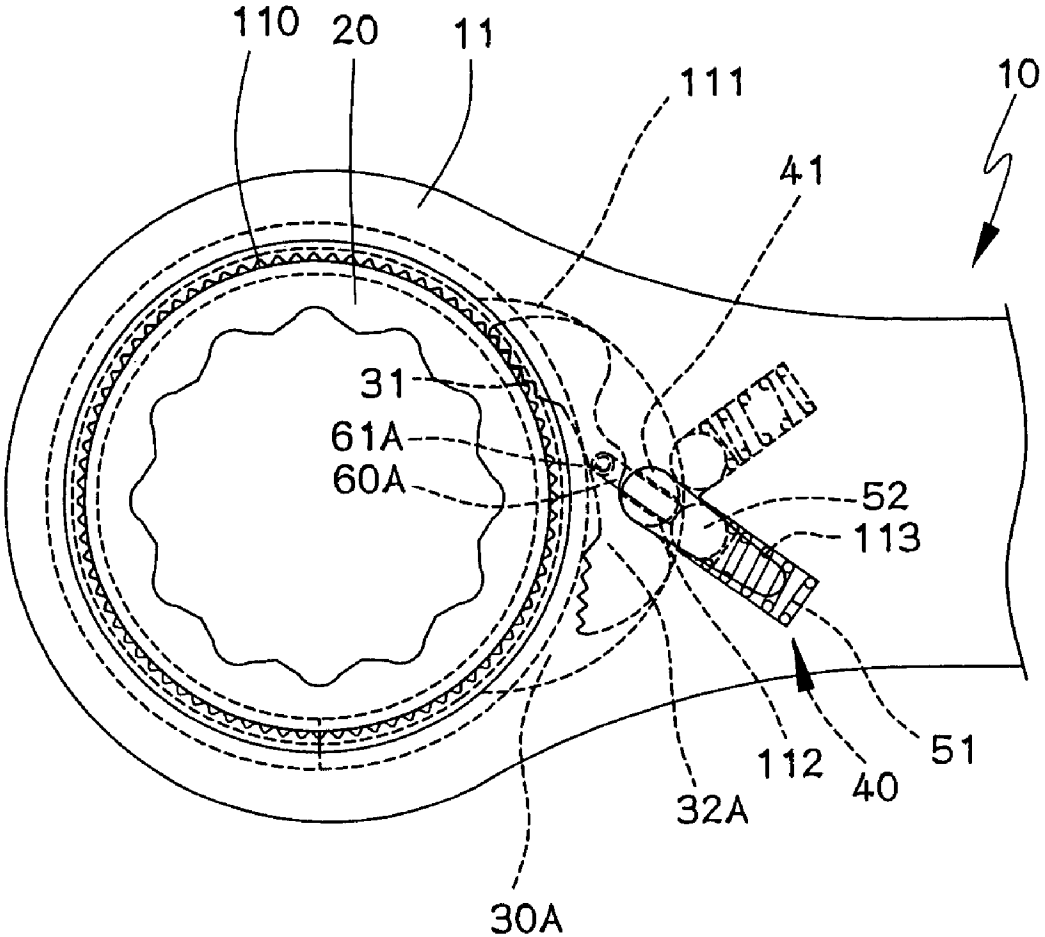
FIG. 8 is a schematic operational view of the wrench as shown in FIG. 7.

Referring to FIGS. 6–8, the pawl member 30A has a first side provided with a pivot portion 32A having a mediate section formed with an open pivot zone 36A, and the driving member 60A has a pivot end 63A pivotally mounted in the pivot zone 36A of the pivot portion 32A of the pawl member 30A by a pivot 61A which is extended through the pivot portion 32A of the pawl member 30A so that the driving member 60A is pivotally connected with the pawl member 30A. In addition, the receiving recess 111 of the drive head 11 has a side formed with two positioning holes 113, and the wrench comprises two positioning devices 50 each mounted in the respective positioning hole 113 of the drive head 11 and each aligned with a rotation direction of the driving slot 410 of the shaft 41 of the direction control knob 40 so that when the driving slot 410 of the shaft 41 of the direction control knob 40 is rotated to align with either one of the two positioning devices 50, the direction control knob 40 is positioned by the respective positioning device 50.

Accordingly, the direction control knob 40 is mounted on the drive head 11 of the wrench body 10 after assembly of the pawl member 30 and the driving member 60, so that the direction control knob 40 is mounted on the drive head 11 of the wrench body 10 easily, rapidly and conveniently, thereby facilitating assembly of the wrench and thereby decreasing costs of production. In addition, the shaft 41 of the direction control knob 40 directly drives the driving member 60 to operate the pawl member 30 so that the pawl member 30 is operated exactly and rapidly, thereby facilitating a user operating the drive head 11 of the wrench body 10 to rotate a workpiece.

Figure 9:
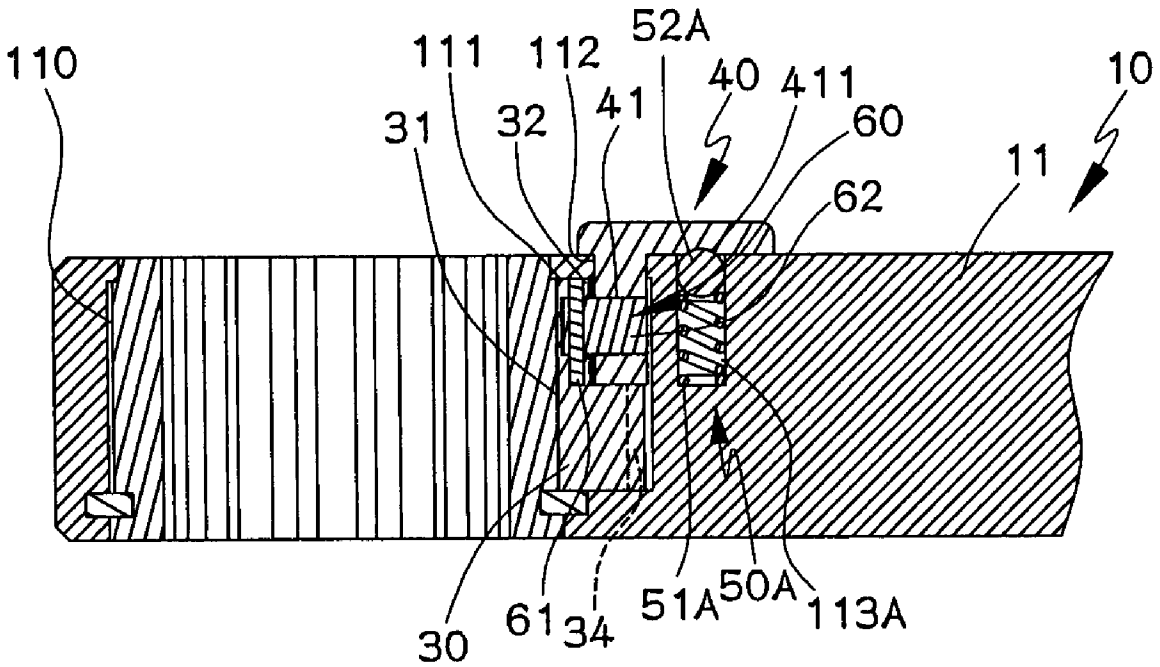
FIG. 9 shows yet another embodiment of the wrench of the present invention.

As shown in FIG. 9 which shows yet another embodiment, wherein a positioning hole 113A is defined in a top of the wrench body 10 and located corresponding to the direction control knob 40 so as to receive the elastic member 51A and the positioning member 52A of the positioning device 50A. The direction control knob 40 has a plurality of positioning notches 411 defined in an underside thereof so as to receive the positioning member 52A at desired direction to show the direction that the wrench is to be operated.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench, comprising:

a wrench body having an end provided with a drive head having an inside formed with a mounting recess having a side formed with a receiving recess connected to the mounting recess;

an actuating member mounted in the mounting recess of the drive head;

a pawl member pivotally mounted in the receiving recess of the drive head and engaged with the actuating member, the pawl member having a side provided with a pivot portion;

a direction control knob rotatably mounted on the drive head and having a shaft extended into the receiving recess of the drive head, the shaft of the direction control knob having a driving slot;

a driving member having a driving portion having a first end including a pivot pivotally connected to the pivot portion of the pawl member and a second end inserted into the driving slot of the shaft of the direction control knob so that the driving member is moved by the shaft of the direction control knob to control movement of the pawl member; and at least one positioning device connected to the drive head and located corresponding to the direction control knob or the pawl member.

2. The wrench in accordance with claim 1, wherein the driving slot is extended through the shaft of the direction control knob.

3. The wrench in accordance with claim 1, wherein the receiving recess of the drive head has a side formed with a positioning hole, and the at least one positioning device is mounted in the positioning hole of the drive head.

4. The wrench in accordance with claim 3, wherein the at least one positioning device includes an elastic member and a positioning member, and the positioning member of the at least one positioning device is partially protruded from the positioning hole of the drive head to position the direction control knob and the driving member.

5. The wrench in accordance with claim 1, wherein the pawl member has a side provided with two pivot portions for pivoting the first end of the driving member.

6. The wrench in accordance with claim 1, wherein the pawl member has a periphery formed with at least one locating portion corresponding to the at least one positioning device for locating the positioning member of the positioning device.

7. The wrench in accordance with claim 1, wherein the pawl member has a side having two ends each provided with an actuating edge to mate with the receiving recess of the drive head.

8. The wrench in accordance with claim 1, wherein the drive head of the wrench body has an end face formed with a through hole connected to the receiving recess to allow passage of the shaft of the direction control knob.

9. The wrench in accordance with claim 1, wherein the pawl member has a side provided with a pivot portion having a mediate section formed with an open pivot zone, and the driving member has a pivot end pivotally mounted in the pivot zone of the pivot portion of the pawl member by a pivot which is extended though the pivot portion of the pawl member so that the driving member is pivotally connected with the paw member.

10. The wrench in accordance with claim 9, wherein the shaft of the direction control knob has a driving slot, and the driving member has a driving portion inserted into the driving slot of the shaft of the direction control knob.

11. The wrench in accordance with claim 1, wherein the receiving recess of the drive head has a side formed with at least one positioning hole, and the at least one positioning device is mounted in the at least one positioning hole of the drive head.

12. The wrench in accordance with claim 11, wherein the at least one positioning device includes an elastic member and a positioning member, and the positioning member of the at least one positioning device is partially protruded from the at least one positioning hole of the drive head to position the direction control knob and the driving member.

13. The wrench in accordance with claim 1, wherein the shaft of the direction control knob has a driving slot, and the at least one positioning device is aligned with a rotation direction of the driving slot of the shaft of the direction control knob so that when the driving slot of the shaft of the direction control knob is rotated to align with the at least one positioning device, the direction control knob is positioned by the at least one positioning device.

14. A wrench, comprising:

a wrench body having an end provided with a drive head having an inside formed with a mounting recess having a side formed with a receiving recess connected to the mounting recess;

an actuating member mounted in the mounting recess of the drive head;

a pawl member pivotally mounted in the receiving recess of the drive head and engaged with the actuating member;

a direction control knob rotatably mounted on the drive head and having a shaft extended into the receiving recess of the drive head;

a driving member having a first end pivotally connected with the pawl member and a second end extended into the shaft of the direction control knob so that the driving member is moved by the shaft of the direction control knob to control movement of the pawl member, and at least one positioning hole defined in a top of the drive head of the wrench body and located corresponding to the direction control knob, at least one positioning device received in the at least one positioning hole, the direction control knob having a plurality of positioning notches defined in an underside thereof and the at least one control device engaged with one of the positioning notches.

15. The wrench in accordance with claim 14, wherein the at least one positioning device includes an elastic member and a positioning member, and the positioning member of the at least one positioning device is partially protruded from the at least one positioning hole of the drive head so as to be engaged with position the one of the positioning notches of the direction control knob.

16. The wrench in accordance with claim 15, wherein the pawl member has a side provided with a pivot portion, the shaft of the direction control knob has a driving slot, and the driving member includes a pivot pivotally mounted on the pivot portion of the pawl member, and a driving portion having a first end pivotally mounted on the pivot so that the driving member is pivotally connected with the pawl member and a second end inserted into the driving slot of the shaft of the direction control knob.

17. The wrench in accordance with claim 16, wherein the driving slot is extended through the shaft of the direction control knob.

18. The wrench in accordance with claim 14, wherein the pawl member has a side provided with two pivot portions for pivoting the first end of the driving member.

19. The wrench in accordance with claim 14, wherein the pawl member has a periphery formed with at least one locating portion corresponding to the at least one positioning device for locating the positioning member of the positioning device.

20. The wrench in accordance with claim 14, wherein the pawl member has a side having two ends each provided with an actuating edge to mate with the receiving recess of the drive head.

21. A wrench, comprising:

a wrench body having an end provided with a drive head having an inside formed with a mounting recess having a side formed with a receiving recess connected to the mounting recess;

an actuating member mounted in the mounting recess of the drive head;

a pawl member pivotally mounted in the receiving recess of the drive head and engaged with the actuating member;

a direction control knob rotatably mounted on the drive head and having a shaft extended into the receiving recess of the drive head; and a driving member having a first end pivotally connected with the pawl member and a second end extended into the shaft of the direction control knob so that the driving member is moved by the shaft of the direction control knob to control movement of the pawl member, the pawl member having a side provided with two pivot portions for pivoting the first end of the driving member.

* * * * *